US005167534A

United States Patent [19]

Ohsumi

[11] Patent Number: 5,167,534

[45] Date of Patent: Dec. 1, 1992

[54] CONNECTOR WITH DOUBLE LOCK MECHANISM

[75] Inventor: Hideki Ohsumi, Shizuoka, Japan

[73] Assignee: Yazaki Corporation, Tokyo, Japan

[21] Appl. No.: 862,444

[22] Filed: Apr. 2, 1992

[30] Foreign Application Priority Data

Apr. 4, 1991 [JP] Japan ..... 3-71409

[51] Int. Cl.[5] ..... H01R 13/426; H01R 13/424

[52] U.S. Cl. ..... 439/595; 439/598; 439/599; 439/752

[58] Field of Search ..... 439/594, 595, 597–600, 439/603, 752

[56] References Cited

U.S. PATENT DOCUMENTS 4,772,229 9/1988 Nix et al. ..... 439/752
4,946,399 8/1990 Kawashima .
4,975,082 12/1990 Nagasaka et al. .
5,066,252 11/1991 Kato et al. ..... 439/752

*Primary Examiner*—Paula A. Bradley
*Attorney, Agent, or Firm*—Sughrue, Mion, Zinn, Macpeak & Seas

[57] ABSTRACT

A connector having a terminal lock plate inserted into an intermediate portion of a housing across terminal receiving holes, in which flexible lock arms for effecting primary locking of terminals have an increased retaining force. The connector includes a main housing (A), a sub-housing (B) inserted into a frame portion provided at the front portion of the main housing, and a terminal lock plate (C), inserted into openings formed respectively through upper and lower walls of the frame portion. The main housing includes a main terminal receiving block having terminal rear half receiving holes. The sub-housing has a terminal receiving sub-block having terminal front half receiving holes corresponding respectively to the terminal rear half receiving holes and a wall portion provided rearwardly of the terminal receiving sub-block so as to close one of the upper and lower openings. The wall portion has flexible lock arms which extend respectively into the terminal front half receiving holes so as to effect primary locking of the terminals. The terminal lock plate has through holes arranged in the same manner as the front half and rear half receiving holes so that the holes are respectively aligned with one another in the locked state.

12 Claims, 5 Drawing Sheets

CONNECTOR WITH DOUBLE LOCK MECHANISM

BACKGROUND OF THE INVENTION

1. Field of the Invention

This invention relates to a connector with a double lock mechanism which has, in addition to a flexible lock arm in each terminal receiving hole of a housing, a terminal locking plate inserted into intermediate portions of the terminal receiving holes.

2. Background

FIGS. 6(A) and 6(B) show one example of a conventional connector with a double lock mechanism. Upper and lower rows of terminal receiving holes b are provided in a connector housing a, and a primary flexible lock arm d for preventing rearward withdrawal of a terminal c is provided in each receiving hole b. The size of the flexible lock arm d is limited because, for example, of the multi-pole compact design of the connector, and therefore the lock arm d does not provide a sufficient terminal retaining force. Accordingly, the terminal c is secondarily locked by a terminal lock plate thereby reinforcing the locking of the terminal.

More specifically, windows f1 and f2 are formed respectively through an upper wall al of the connector housing and a partition wall a2 in the connector housing (FIG. 6(A)), and the terminal lock plate e is inserted into the housing through the windows, so that a retaining portion el of the lock plate e is engaged with a shoulder c1 of the terminal c (FIG. 6(B)) to thereby achieve secondary locking together with the primary locking of flexible lock arm d.

The problem associated with the double lock construction shown in FIGS. 6A and 6B, is that it necessary to form the window f2 in part of the partition wall a2 in order to allow the insertion of the terminal lock plate e. Therefore, as shown in FIG. 7(A) on an enlarged scale, there is not a sufficient space for supporting the fulcrum portion d1 of the flexible lock arm d in each of the upper terminal receiving holes b. Accordingly, as shown in FIG. 7(B), the flexible lock arm d is liable to be damaged at its proximal portion d1, for example, by a tension exerted on a connected wire, so that the intended primary retaining force can not be obtained.

With the above problem in view, it is an object to this invention to provide a connector with a double lock mechanism which provides a high locking force to retain terminals without the possibility of damaging any flexible lock arm for effecting primary locking of the terminal.

SUMMARY OF THE INVENTION

The above object has been achieved by a connector with a double lock mechanism, comprising a main housing which has at one side portion thereof a main terminal receiving block having a plurality of terminal rear half receiving holes for respectively receiving rear half portions of terminals, and a frame portion at the other side portion thereof which has opposed openings formed respectively through upper and lower walls of the frame portion adjacent to the terminal receiving block; a sub-housing which is adapted to be inserted into the frame portion, and includes a terminal receiving sub-block having a plurality of terminal front half receiving holes corresponding respectively to the terminal rear half receiving holes, and a wall portion provided rearwardly of the terminal receiving sub-block so as to close one of the upper and lower openings, the wall portion having flexible lock arms which extend respectively into the terminal front half receiving holes and serve to prevent the terminals from being withdrawn rearwardly; and a terminal lock plate having through holes arranged in the same manner as the front half and rear half receiving holes, the terminal lock plate being releasably inserted into the main housing from the other opening.

Preferably, a retaining means is provided between the main housing and the sub-housing, and a provisionally-stopping means is provided between the main housing and the terminal lock plate. When the terminal lock plate is inserted into the main housing from the other opening until the through holes of the terminal lock plate are brought into registry respectively with the terminal rear half receiving holes of the main housing, the provisionally-stopping means temporarily stops the terminal lock plate at the inserted position. The terminal lock plate is then retained at an insertion-completed position when the terminal lock plate is moved to the insertion-completed position from the provisionally-stopped position, with the sub-housing inserted and retained in the frame portion.

In the present invention, the connector housing is divided into the main housing with the front frame portion and the sub-housing inserted into the front frame portion, and the flexible lock arms for effecting the primary locking of the terminals are provided on the sub-housing. With this construction, a sufficient space for supporting the fulcrum portion of the flexible lock arm can be secured. Therefore, the flexible lock arm has an increased strength at its proximal end portion, the terminal retaining force can be increased, and the reliability in the electrical connection is enhanced.

DETAILED DESCRIPTION OF THE INVENTION

Figure 1:
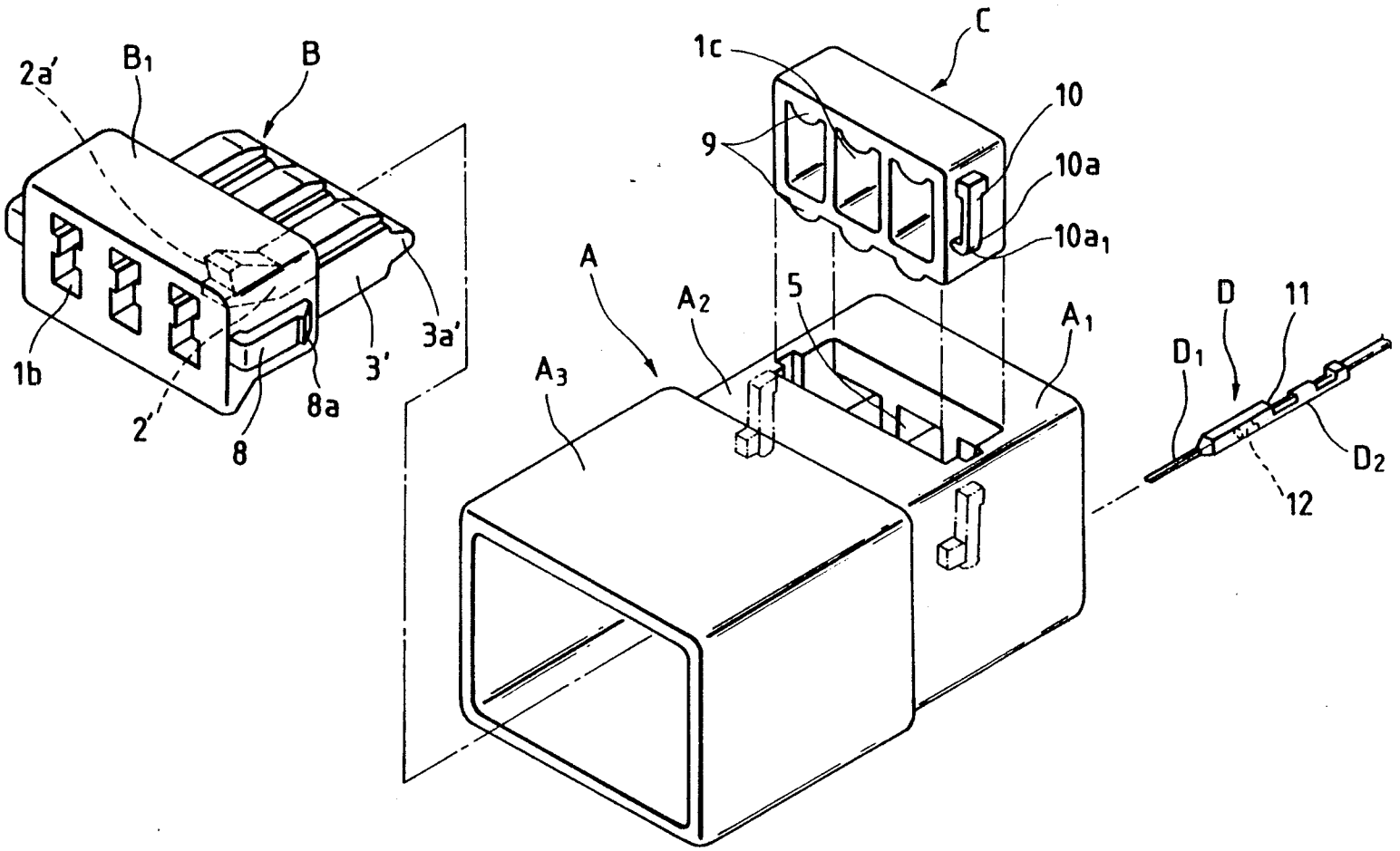
FIG. 1 is an exploded perspective view of a preferred embodiment of a connector according to the present invention.
Figure 3A:
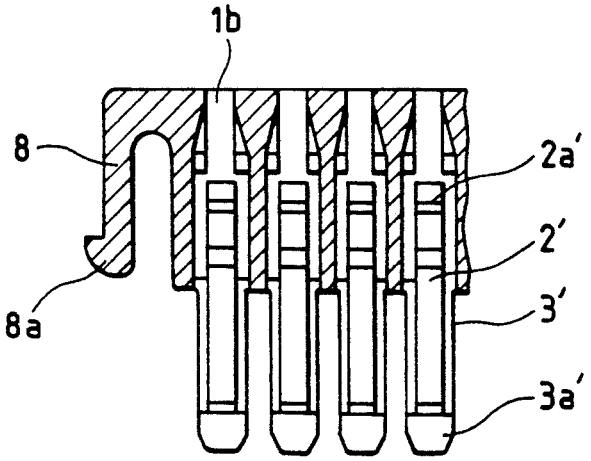
FIG. 3(A), 3(B) and 3(C) are cross-sectional views taken along the line 3(A)—3(A), line 3(B)—3(B) and line 3(C)—3(C) of FIG. 2, respectively.
Figure 3B:
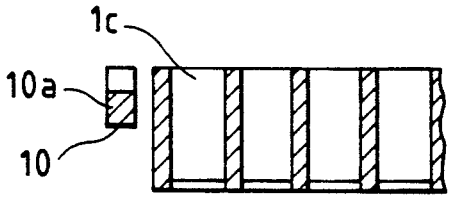

Referring to FIGS. 1 and 3, the connector includes a main housing A, a sub-housing B and a terminal lock plate C each made of an insulative synthetic resin. Reference character D denotes a male terminal.

The main housing A is shown as a female connector housing, and includes a main terminal receiving block A1, a frame portion A2 formed forwardly of this block, and a hood A3 formed forwardly of and integrally with the frame portion A2. A male connector (not shown) is adapted to be fitted in the hood A3. Upper and lower rows of terminal receiving holes 1 are provided in the main terminal receiving block A1, and are separated from each other by a partition wall 3. In this embodiment, each of the receiving holes in the upper row serves as a terminal rear half receiving hole 1*a* for receiving the rear half portion (i.e., a wire connecting portion D2) of the male terminal D. Each of the terminal receiving holes of the lower row is similar in construction to a conventional arrangement and has a flexible lock arm 2 formed on an inner surface thereof which extends forwardly and has at its free end a retaining projection 2*a*.

Figure 2:
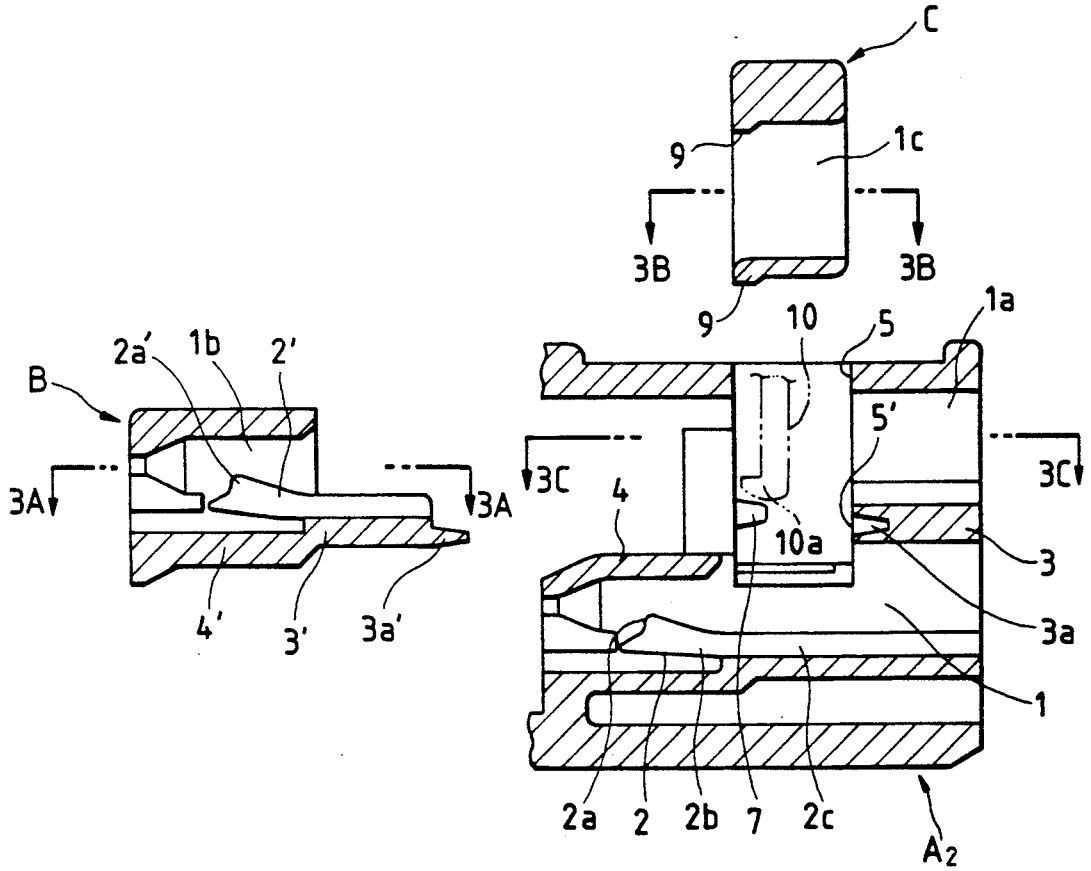
FIG. 2 is a vertical cross-sectional view showing a main housing, a sub-housing and a terminal lock plate in FIG. 1.
Figure 3C:
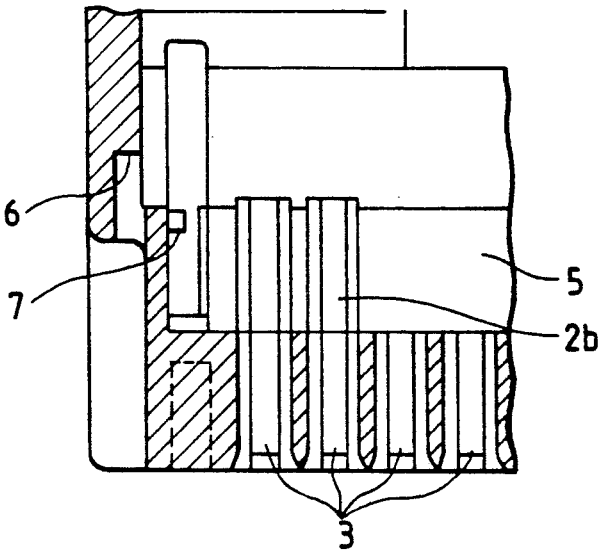

Provided in the frame portion A2 adjacent the main terminal receiving block A1 are openings 5 and 5' respectively formed in the outer peripheral wall of the frame portion A2 and the partition wall 3, the openings 5 and 5' being disposed in opposed relation to each other. The openings 5 and 5' are provided for receiving the terminal lock plate C, and are disposed in registry with a rear half portion 2*c* of the flexible lock arm 2 (which includes a fulcrum portion 2*b*) disposed in each lower terminal receiving hole 1 as shown in FIG. 2. As a result, the partition wall of the main housing A is divided into the partition wall 3, disposed rearwardly of the opening 5', and a partition wall 4 disposed forwardly of this opening. As shown in FIG. 3(C), a retaining step 6 and a retaining projection 7, disposed rearwardly of the retaining step, are formed on the inner surface of each of the opposite side walls of the frame portion A2, the purpose of which is described below.

The sub-housing B includes a terminal receiving sub-block B1 adapted t o be inserted into the upper portion of the frame portion A2. The block B1 has terminal front half receiving holes 1*b* arranged in corresponding relation to the terminal rear half receiving holes 1*a* of the main housing A. A wall portion 3' for closing the opening 5' is projected from the rear end of the terminal receiving sub-block B1, and flexible lock arms 2' are formed integrally with and project from the wall portion 3' toward the terminal front half receiving holes 1*b*. This flexible lock arm 2' may have the same construction as that of the flexible lock arm 2. Flexible retaining arms 8, each having a retaining pawl 8*a* at its free end, are formed on the opposite side faces of the terminal receiving sub-block B1, respectively.

The terminal lock plate C is of a frame-like construction having through holes 1*c* arranged substantially in the same manner as the terminal rear half receiving holes 1*a* and the terminal front half receiving holes 1*b* so as to be aligned therewith when the lock plate is inserted into the main housing A. Retaining portions 9, each adapted to engage a shoulder 11 of an electrical contact portion D1 of the male terminal D, are formed respectively on the front edges of the upper and lower walls of each through hole 1*c*, and downwardly-directed flexible retaining arms 10 are formed respectively on the opposite side faces of the terminal lock plate C, as best shown in FIG. 1.

Figure 4:
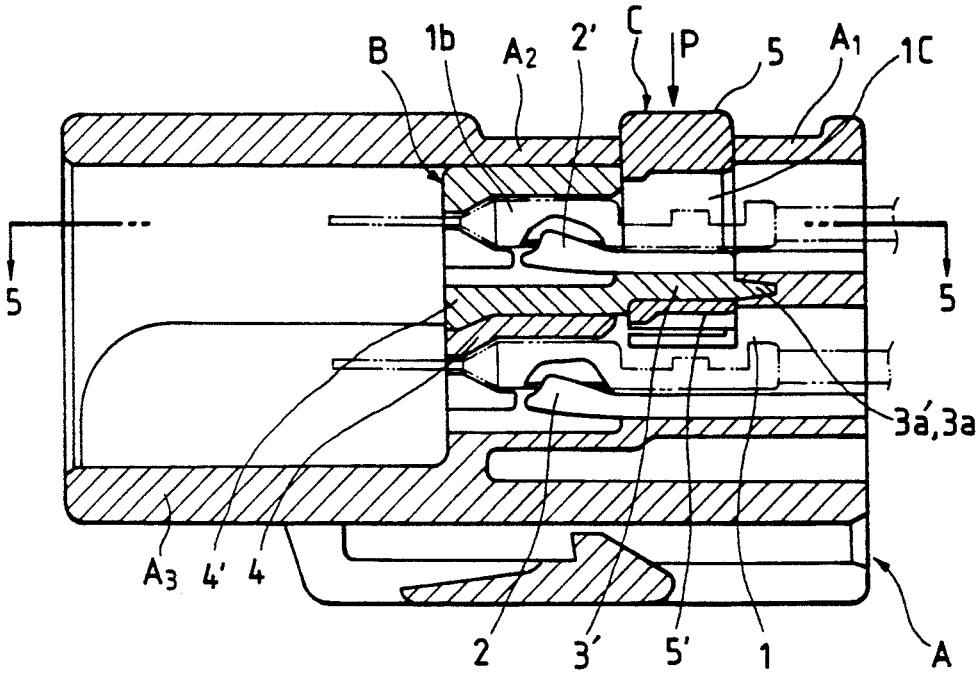
FIG. 4 is a vertical cross-sectional view of an important portion of the connector in a provisionally-retained condition of the terminal lock plate.

In the above construction, the terminal lock plate C is inserted through the opening 5 in the frame portion A2 of the main housing A, as shown in FIG. 4. The terminal lock plate C is retained in a provisionally-retained position when retaining pawls 10*a* of the flexible retaining arms 10 on the opposite side faces thereof abut respectively against the retaining projections 7 in the frame portion A2 (see FIG. 2). In this provisionally-retained position, the through holes 1*c* of the terminal lock plate C are in registry with the terminal rear half receiving holes 1*a* of the main terminal receiving block A1, respectively, and the lower edge of the plate C is disposed slightly below the lower opening 5, as illustrated in FIG. 2. Namely, the terminal lock plate C is provisionally retained in the frame portion A2.

Figure 5:
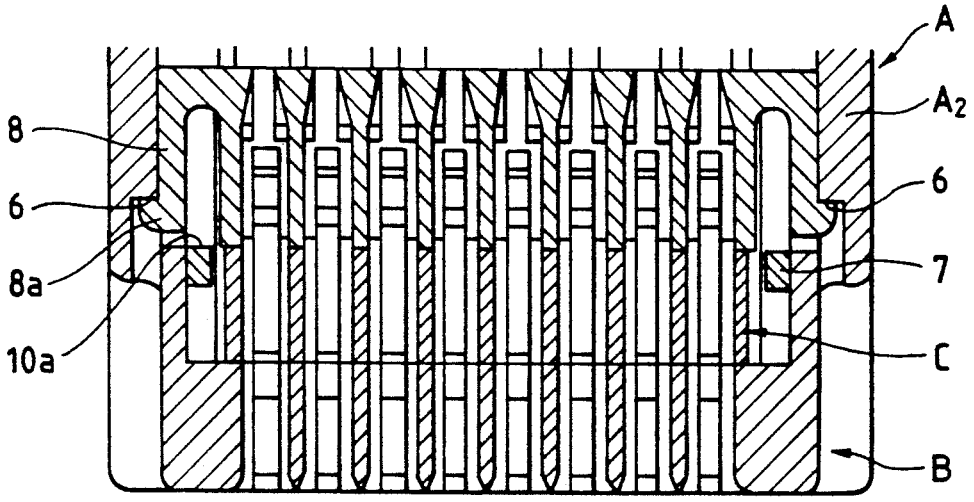
FIG. 5 is a cross-sectional view taken along the line 5—5 of FIG. 4.
Figure 7A:
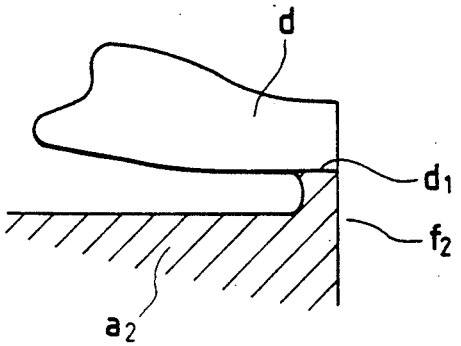
FIG. 7(A) PRIOR ART
FIGS. 7(A) and 7(B) are enlarged views showing a flexible lock arm for a terminal in FIG. 6.

In the above provisionally-retained condition of the terminal lock plate C, when the sub-housing B is inserted from the front side of the frame portion A2, the wall portion 3' closes the opening 5'. Further, the bottom wall 4' of the sub-housing B is supported by the partition wall 4, and the retaining pawls 8*a* on the distal ends of the flexible retaining arms 8 on the opposite side faces thereof are engaged respectively with the retaining steps 6 in the frame portion A2, as shown in FIG. 5, so that the sub-housing B is thereby retained. At this time, a convex portion 3*a'* at the distal end of the wall portion 3' is fitted in a recess 3*a* formed in the partition wall 3 to thereby prevent angular movement of the sub-housing B. Also, in this condition, the wall portion 3' of the sub-housing B is inserted in the through holes 1*c* of the terminal lock plate C so that upward withdrawal of the terminal lock plate C is positively prevented. In this condition, the front half receiving holes 1*b*, the through holes 1*c* and the rear half receiving holes 1*a*, provided respectively in the sub-housing B, the terminal lock plate C and the main housing A, communicate with one another.

Figure 6A:
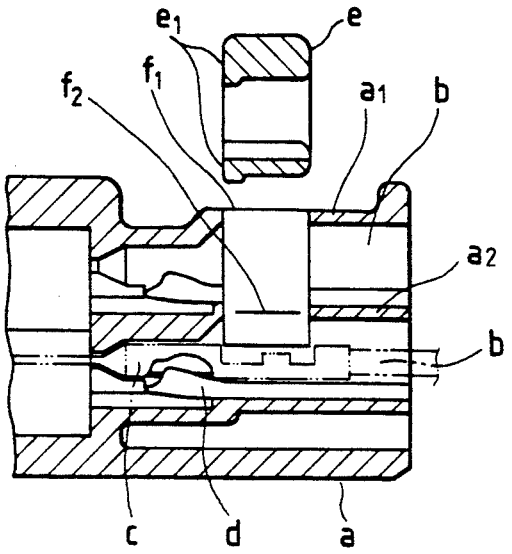
FIG. 6(A) PRIOR ART
FIGS. 6(A) and 6(B) are cross-sectional views of a portion of a conventional connector, showing a separated condition and a provisionally-retained condition of a terminal lock plate, respectively.
Figure 6B:
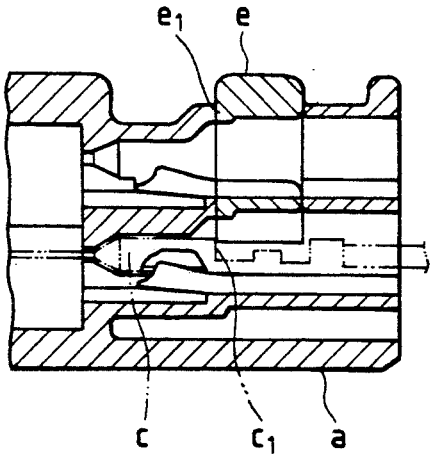
FIG. 6(B) PRIOR ART
Figure 7B:
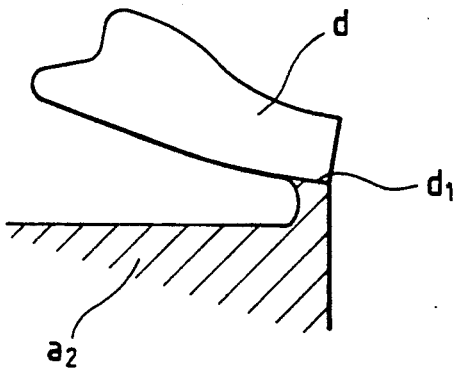
FIG. 7(B) PRIOR ART

In the above provisionally-retained condition of the sub-housing B, the male terminals D are inserted into the upper receiving holes 1*b*, 1*c* and 1*a* and the lower receiving holes 1 from the rear side of the main housing A. As in the conventional construction, the retaining projections 2*a* of the flexible lock arms 2' and 2 in the receiving holes are engaged respectively with retaining holes 12 of the male terminals D, thereby achieving the primary locking. Thereafter, the terminal lock plate C is pushed in a direction of arrow P (FIG. 4), so that the retaining pawls 10*a* of the flexible retaining arms 10, guided by their tapered surfaces, are flexed to thereby slide respectively over the retaining projections 7 to be positioned therebelow, thereby achieving a complete locking of the terminal lock plate C. In this completely-locked position of the terminal lock plate respectively with the shoulders 11 of the electrical contact portions D1 of the male terminals D, as is the case with the conventional constructions shown in FIG. 6(B), so that each terminal is secondarily locked.

In the above description, although the terminal receiving block A1 of the main housing A has the terminal receiving holes 1 arranged in two (upper and lower) stages, the terminal receiving holes may be arranged, for example, in three states, in which case the through holes 1*c* of the terminal lock plate C would be arranged in two (upper and lower) stages. Thus, the present invention can be applied to a multi-pole connector having any desired number of stages. The invention can also be applied to a male connector not provided with the hood A3.

As described above, according to the present invention, with respect to some of the terminal receiving holes in the connector housing, the flexible lock arms for effecting the primary locking of the terminals, as well as the fulcrum portions thereof, are provided separately from the main housing for at least some of the terminal receiving holes of the connector. Therefore, even with the type of connector using the insertable terminal lock plate, a sufficient space for supporting the fulcrum portions is provided. As a result, the proximal end portion of the flexible lock arm has an increased strength so that the terminal retaining force is correspondingly increased so that the reliability of the electrical connection is enhanced.

What is claimed is:

1. A connector with a double lock mechanism, comprising:

a main housing including a main terminal receiving block at one side thereof having a plurality of terminal rear half receiving holes for respectively receiving rear half portions of terminals, and a frame portion at the other side portion thereof having opposed openings formed respectively through upper and lower walls of said frame portion adjacent to said terminal receiving block;

a sub-housing adapted to be inserted into said frame portion, and including a terminal receiving sub-block having a plurality of terminal front half receiving holes corresponding respectively to said terminal rear half receiving holes, and a wall portion provided rearwardly of said terminal receiving sub-block so as to close one of said upper and lower opening when said sub-housing is inserted into said frame portion, said wall portion having flexible lock arms which extend respectively into said terminal front half receiving holes and which prevent said terminals from being withdrawn rearwardly; and a terminal lock plate having through holes therein and being releasably insertable into said main housing through the other of said upper and lower openings, said through holes being aligned with said front and rear half receiving holes when said lock plate is inserted into said main housing to a provisionally retained position.

2. The connector of claim 1, further comprising first means for provisionally retaining said lock plate in said provisionally retained position in said main housing, and second means for retaining said terminal lock plate at an insertion completed position when said terminal lock plate is moved to said insertion-completed position from said provisionally retained position, with said sub-housing inserted and retained in said frame portion.

3. The connector of claim 2, wherein said terminal lock plate includes a locking device which secondarily locks said terminals in said terminal receiving holes when said terminal lock plate is in said insertion-completed position.

4. The connector of claim 3, wherein said sub-housing includes locking means for locking said lock plate in said insertion-completed position.

5. The connector of claim 2, wherein said lock plate includes an engaging portion which engages said terminals when said lock plate is disposed in said insertion-completed position.

6. A connector, comprising:

a main housing having upper and lower rows of rear terminal receiving holes provided therein for respectively receiving terminals, said upper and lower rows being separated by a partition wall, said main housing including first locking mechanisms for respectively primarily locking terminals in one of said upper and lower rows of rear receiving holes;

a sub-housing insertable into said main housing and including second locking mechanisms for respectively primarily locking said terminals in the other of said upper and lower rows of rear receiving holes; and a terminal lock means insertable into said main housing for secondarily locking said terminals in each of said upper and lower rows of rear receiving holes.

7. The connector of claim 6, wherein said sub-housing is insertable into said main housing from a front side thereof, opposite a rear side from which the terminals are inserted, and wherein said sub-housing has a plurality of front terminal receiving holes, aligned with said rear terminal receiving holes, into which a front portion of each of said terminals is received.

8. The connector of claim 7, wherein said terminal locking means includes a locking plate having through holes provide therein for respectively receiving the terminals, and wherein said main housing includes means for retaining said locking plate in a provisionally retained position in which said through holes are aligned with said front and rear terminal receiving holes.

9. The connector of claim 8, wherein said locking plate includes a secondary terminal retaining mechanism for secondarily retaining each of said terminals, said secondary terminal retaining mechanism engaging said terminals when said locking plate is disposed in a completely retained position.

10. The connector of claim 7, wherein said terminal locking means is insertable into said main housing from a side which is substantially perpendicular to said front and rear sides of said main housing.

11. A connector, comprising:

a main housing having upper and lower rows of terminal rear half receiving holes provided therein which are separated by a partition wall, said housing including first flexible lock arms provided therein proximate said lower row of receiving holes, said housing having openings respectively formed in an upper wall which partially defines said upper row of rear half receiving holes, and in said partition wall;

a sub-housing insertable into said main housing and having terminal front half receiving holes corresponding to said upper row of rear half receiving holes, said sub-housing including a wall portion and a plurality of second flexible lock arms respectively extending from said wall portion toward said rear half receiving holes; and a terminal lock plate for locking said terminals in said housing, said terminal lock plate having through holes therein and being insertable into said openings of said housing in such a manner that said through holes are respectively aligned with said front half receiving holes and said rear half receiving rows in said upper row, wherein when said sub-housing and said terminal lock plate are inserted into said main housing, the terminals are respectively insertable into said upper and lower rows of receiving holes, the terminals provided in said upper row of receiving holes being respectively locked by said second lock arms and the terminals provided in said low row of receiving holes being respectively locked by said first lock arms.

12. The connector of claim wherein when said sub-housing and said lock plate are inserted into said main housing, said wall portion of said sub-housing covers said opening in said partition wall.

* * * * *